United States Patent [19]

McCormick

[11] Patent Number: 4,940,402

[45] Date of Patent: Jul. 10, 1990

[54] HIGH PRESSURE AND HIGH LIFT PUMP IMPELLER

[75] Inventor: Daniel F. McCormick, Oshkosh, Wis.

[73] Assignee: Brunswick Corporation, Skokie, Ill.

[21] Appl. No.: 268,749

[22] Filed: Nov. 8, 1988

[51] Int. Cl.[5] ..... F04C 5/00

[52] U.S. Cl. ..... 418/154

[58] Field of Search ..... 418/154, 155, 156, 153

[56] References Cited

U.S. PATENT DOCUMENTS

| | | | |
|---|---|---|---|
| 2,189,356 | 2/1950 | Briggs | 418/154 |
| 2,203,974 | 6/1940 | Weinhardt | 418/154 |
| 2,455,194 | 11/1948 | Rumsey | 418/154 |
| 2,466,440 | 4/1949 | Kiekhaefer | 418/154 |
| 2,664,050 | 12/1953 | Abresch | 418/154 |
| 2,789,511 | 4/1957 | Doble | 418/154 |
| 2,911,920 | 11/1959 | Thompson | 418/154 |
| 4,392,779 | 7/1983 | Bloemers et al. | 418/154 |
| 4,718,837 | 1/1988 | Frazzell | 418/154 |

FOREIGN PATENT DOCUMENTS

| | | | |
|---|---|---|---|
| 466867 | 7/1950 | Canada | 418/154 |
| 1023469 | 1/1958 | Fed. Rep. of Germany | 418/154 |
| 63-159687 | 7/1988 | Japan | 418/156 |
| 174662 | 3/1961 | Sweden | 418/154 |

*Primary Examiner*—John J. Vrablik

*Attorney, Agent, or Firm*—Andrus, Sceales, Starke & Sawall

[57] ABSTRACT

In a rotary vane positive displacement pump (28), the pump impeller (56) has weights (68–73) at the outer tips of the vanes (58–63) of greater mass per unit volume than the vanes and increasing outward centrifugal force urging engagement of the outer tips against the pump housing sidewall (44). In another embodiment, enlarged outer tips (86) of the vanes (82) are offset from the radial center-line (83) of the vane in a direction opposite the direction of rotation. In a further embodiment, a plurality of filler blades (91–96) are provided between respective vanes (101–106) and occupy space therebetween and displace volume in the pumping chamber (46). The filler blades have tapered leading edges (93*a*) accommodating flexure of the respective vane (103) during greatest flexure thereof. In further embodiments, the leading edges of the filler blades have a concave arcuate profile (128, 146) receiving in complementary relation enlarged outer tips (122, 138) of respective vanes upon flexure thereof.

2 Claims, 4 Drawing Sheets

HIGH PRESSURE AND HIGH LIFT PUMP IMPELLER

BACKGROUND AND SUMMARY

The invention arose during continuing development efforts toward improved marine drive water pumps, and particularly a pump impeller for a rotary vane positive displacement pump.

A rotary vane positive displacement pump has a pump driveshaft extending axially through a pump housing having a circumferential sidewall defining a pumping chamber. An impeller has a hub portion driven by the driveshaft and a plurality of flexible vanes extending radially outwardly therefrom in the chamber and having outer tips engaging the sidewall. During rotation of the driveshaft, the vanes move through portions of varying flexure to draw water or other pumped media in through an inlet and discharge same through an outlet. The vanes must be pliable enough to flex and enable rotation and pumping action, yet stiff enough to engage or remain adjacent the sidewall, in order to maintain water pumping efficiency and sufficient pump pressure capability. If the vanes are too flexible, the outer tips of the vanes do not remain close enough to the sidewall, and too much water flows past the vanes between the outer tips and the sidewall, which in turn reduces water pumping efficiency and pump pressure capability. There is thus a trade-off between flexibility and stiffness of the vanes, which presents a problem in the prior art.

Another problem in the prior art, in a marine drive, is poor air pumping efficiency, which in turn limits the height to which water can be drawn to the pump, or at least presents priming problems. In a marine drive, the lower the water pump, the less air has to be pumped before water is drawn upwardly to the pump. Conversely, the higher the pump the more air has to be drawn and pumped. Poor air pumping effiency means that a marine drive water pump may need to be mounted at a lower location on the gearcase than otherwise desired.

The present invention addresses and solves both of the above-noted problems. The invention provides impeller vanes which are flexible enough to enable pumping action, yet which act as very stiff members providing a high pressure head and increasing pump pressure capability, solving the above noted trade-off problem. The invention also improves air pumping efficiency, providing improved priming, and enabling considerable design flexibility in the vertical placement of a marine drive water pump, i.e. the improved air pumping efficiency provides a higher dry lift capability, which in turn enables the pump to lift water to a higher level to reach the pump.

By solving both of the noted problems, individually and in combination, the invention has widespread application, particularly where higher pressure and/or higher dry lift is desired.

DETAILED DESCRIPTION

Figure 1:
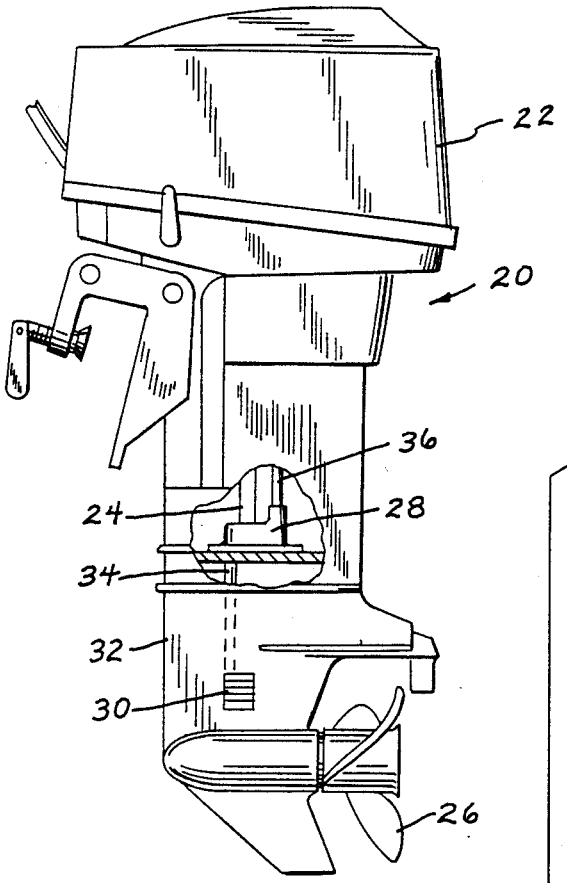
FIG. 1 is a partially broken away side view of a marine drive showing the water pump.

The marine drive is shown as an outboard engine 20 in FIG. 1, similarly as shown in Bloemers et al U.S. Pat. No. 4,392,779, incorporated herein by reference. For further background, reference is also made to Frazzell U.S. Pat. No. 4,718,837 and Kiekhaefer U.S. Pat. No. 2,466,440, incorporated herein by reference. The drive includes a liquid cooled powerhead 22 that drives the driveshaft 24 which in turn rotates propeller 26. The engine is cooled by water supplied by pump 28. During rotation of driveshaft 24, water is drawn in through water inlets 30 on the side of gearcase 32 and then upwardly through inlet tube 34 to pump 28. The pump discharges the water upwardly through outlet tube 36 to the powerhead.

Figure 2:
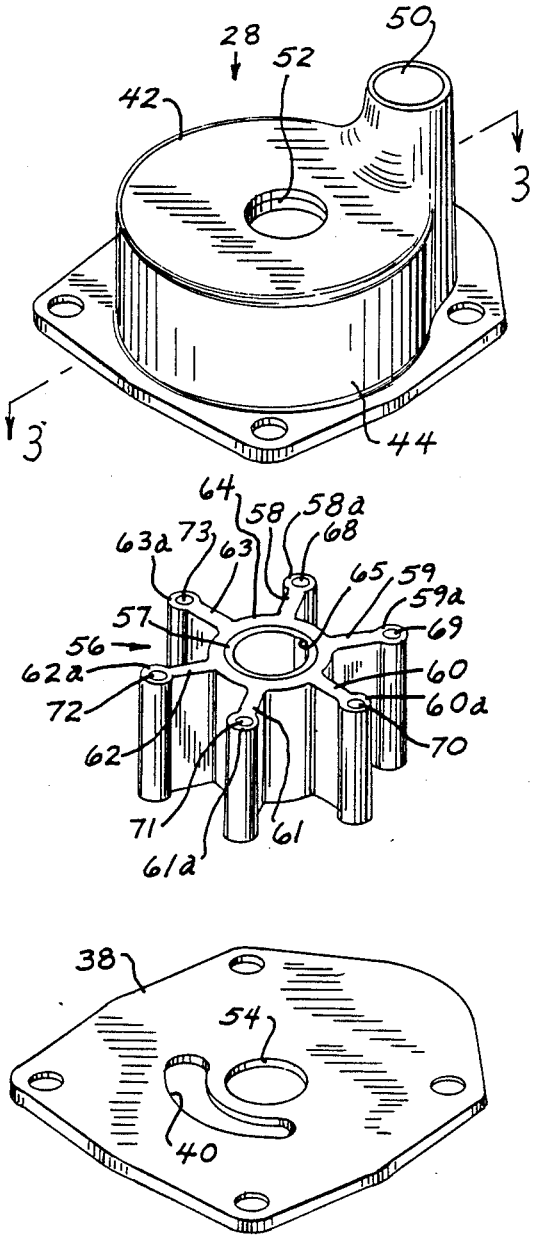
FIG. 2 is an exploded perspective view of a pump impeller in accordance with the invention, and housing components.

The pump housing may have various configurations, including that shown in the above incorporated Bloemers et al patent, and that shown in FIG. 2. Pump 28 in FIG. 2 includes a bottom plate 38 with an inlet opening 40, and an upper housing section 42 having a circumferential sidewall 44 defining a pumping chamber 46, FIG. 3. The pumping chamber may have a discharge outlet as shown in the incorporated Bloemers et al patent, or sidewall 44 may have a plurality of elongated arcuate openings 48 therethrough, FIGS. 3 and 4, communicating with side chamber 49 which in turn communicate with top outlet 50 connected to discharge outlet tube 36. The pump housing is known in the prior art. Pump housing section 42 and lower plate 38 have respective apertures 52 and 54 through which driveshaft 24 extends, to drive the pump, all as is well known.

Figure 3:
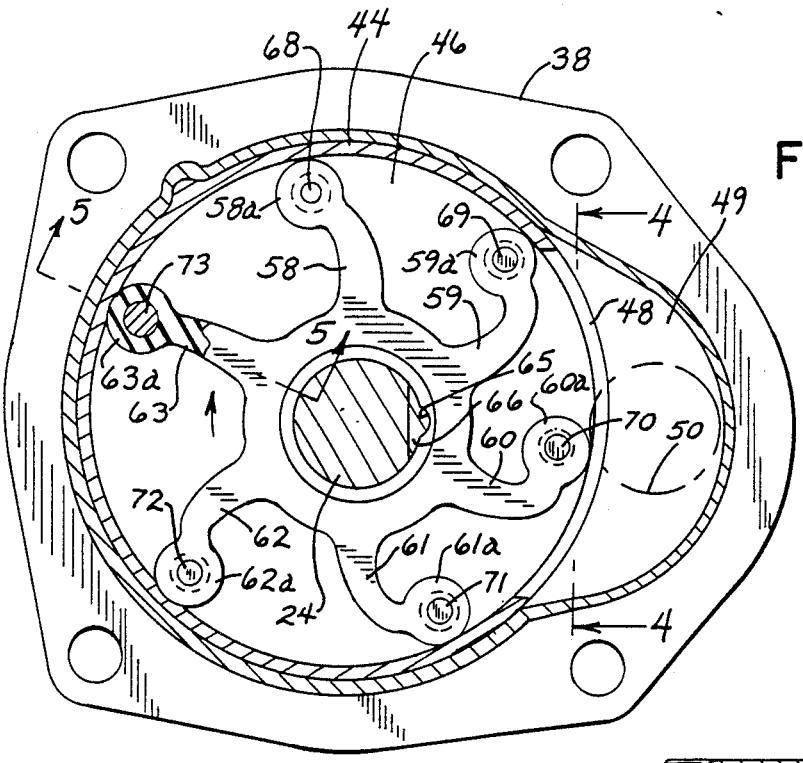
FIG. 3 is a sectional view taken along line 3—3 of FIG. 2, and showing the driveshaft.
Figure 4:
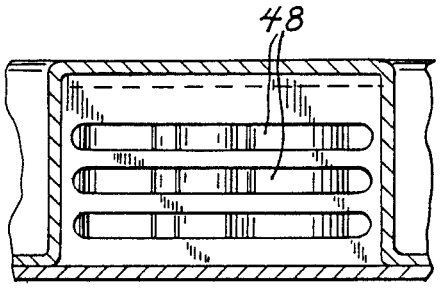
FIG. 4 is a sectional view taken along line 4—4 of FIG. 3.

Pump impeller 56, FIG. 2, includes an annular hub portion 57 driven by driveshaft 24, and a plurality of flexible vanes 58, 59, 60, 61, 62, 63 extending radially outwardly from hub portion 57. In preferred form, hub portion 57 is an annular brass member, and vanes 58–63 are rubber and have an annular base portion 64 bonded to the brass hub insert 57. Insert 57 has a key way slot 65 and is driven by driveshaft 24 in keyed relation by key 66, comparable to key 44 in the incorporated Bloemers et al patent. Driveshaft 24 extends axially through the pump housing and is eccentrically offset within pumping chamber 46. During rotation of the driveshaft, vanes 58–63 move through portions of varying flexure, FIG. 3, to provide pumping action drawing water in through inlet 40 and discharging water out through outlets 48 and 50. In FIG. 3, the driveshaft and impeller rotate clockwise. The vanes have enlarged outer tips 58*a*, 59*a*, 60*a*, 61*a*, 62*a*, 63*a*, engaging circumferential sidewall 44. The structure and pumping action described thus far is known in the prior art.

In the present invention, a plurality of weights 68, 69, 70, 71, 72, 73 are provided at the outer tips 58*a*, 59*a*, 60*a*, 61*a*, 62*a*, 63*a*, respectively, of the vanes, and are of greater mass per unit volume than the vanes. The weights increase outward centrifugal force urging engagement of outer tips 58*a* -63*a* against sidewall 44. This provides the above-noted increased pump pressure capability without the noted trade-off. The vanes flex and enable pumping action, yet the vanes act as substantially stiffer members and do not allow wide gaps between the outer tips of the vanes and circumferential sidewall 44 which would otherwise decrease pumping pressure. Instead, the centrifugal force provided by the added weights makes the vanes act as stiffer members and provides a higher pressure head. In the preferred embodiment, the weights have substantially more mass per unit volume than the vanes. The preferred material for the weights is brass, though other materials may be used, including tungsten carbide. Weights in the form of rods may be solid or tubular.

Figure 5:
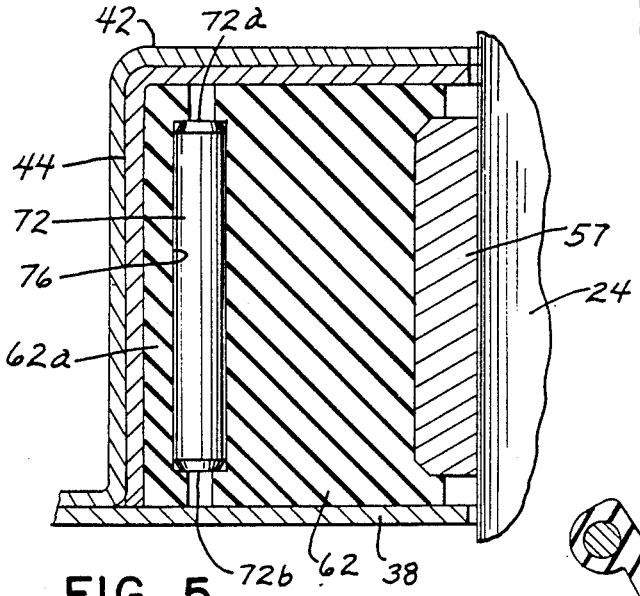
FIG. 5 is a sectional view taken along line 5—5 of FIG. 3.

Vanes 58–63 have a given axial extent extending parallel to driveshaft 24. Outer tips 58*a*–63*a* of the vanes have respective axially extending cavities therein, for example, as shown at cavity 76, FIG. 5, in outer tip 62*a* of vane 62. The weights are axially extending rods received in the cavities, as shown at rod 72 in FIG. 5. The rods extend axially along substantially the entire axial extent of the vanes such that increased outward centrifugal force is applied along substantially the entire axial extent of the vanes at the respective outer tips. The rods may be recessed slightly inwardly of the axial ends of the vanes, as shown at axial ends 72*a* and 72*b* of rod 72 in FIG. 5. The rods are preferably formed in place during molding of the impeller, though the rods may be inserted after such molding.

Figure 6:
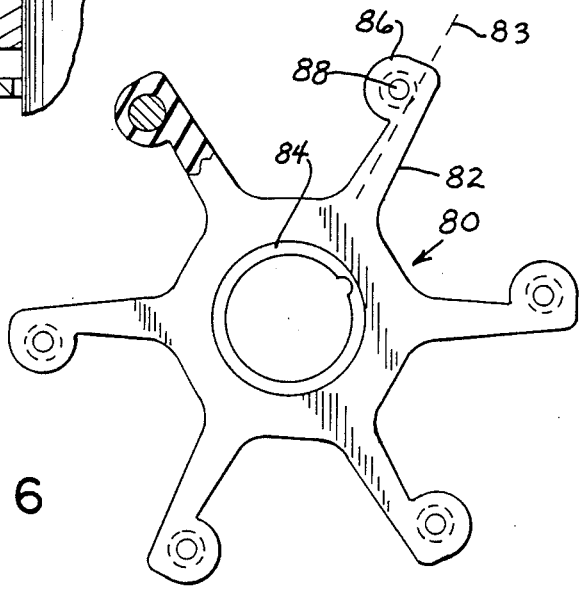
FIG. 6 is a top view of an alternate embodiment of the impeller of FIG. 3.
Figure 7:
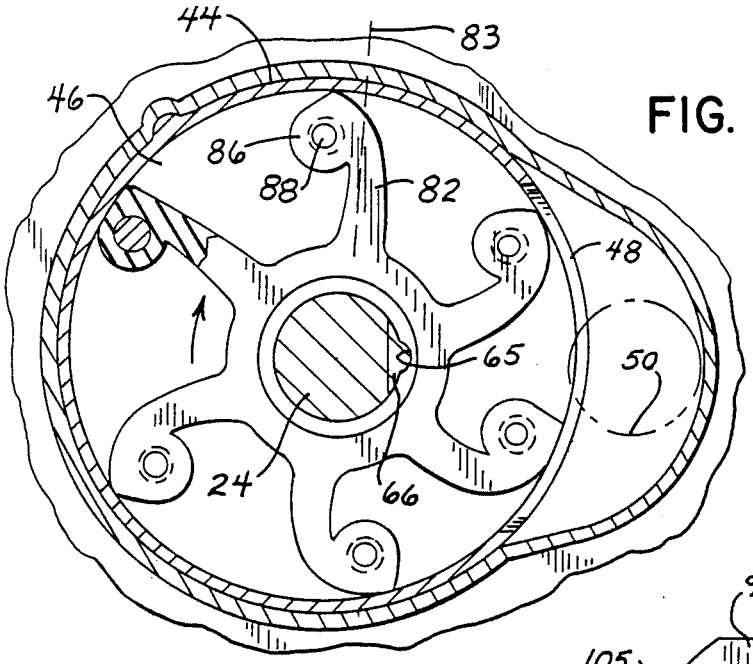
FIG. 7 is a view like FIG. 3 but shows the impeller of FIG. 6.

FIG. 6 shows an alternate impeller embodiment. Impeller 80 has vanes such as 82 extending along a given respective radial center-line 83 from hub portion 84. The vane has an enlarged outer tip 86 with a weight 88 offset from radial line 83. During rotation of the driveshaft in a clockwise direction, FIG. 7, vane 82 flexes in the opposite direction of such rotation. Weight 88 is offset toward such opposite direction, i.e. leftwardly and counterclockwise away from radial line 83. The offset of weight 88 toward the opposite direction of rotation is preferred because of the moment arm provided between radial center-line 83 and weight 88 on the opposite side of line 83 from the high water pressure side. This in turn enables the centrifugal force provided by the weight to be translated into a bending and flexing moment for the vane in addition to the outward stretching force thereon. This combined effect provides better flexing and pumping action.

In a further embodiment of FIG. 6, the weights such as 88 are omitted, and the outer tips such as 86 of the vanes are enlarged and offset from radial line 83 in the direction opposite to rotation of the driveshaft such that the enlarged outer tip 86 trails behind radial line 83 of the vane during flexure of the latter during rotation of the driveshaft.

Figure 8:
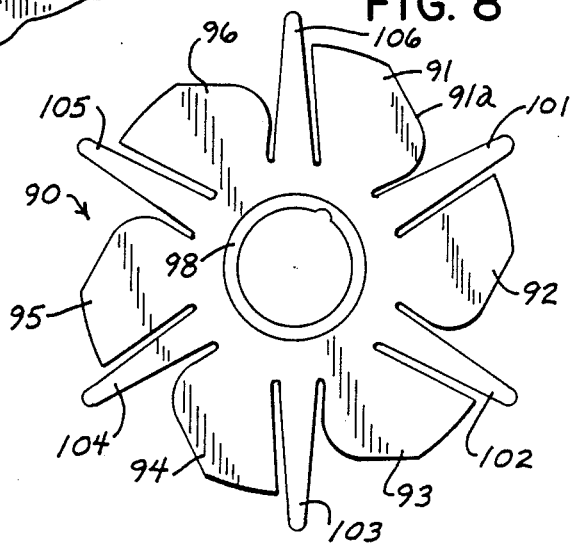
FIG. 8 is a top view of another alternate impeller embodiment.
Figure 10:
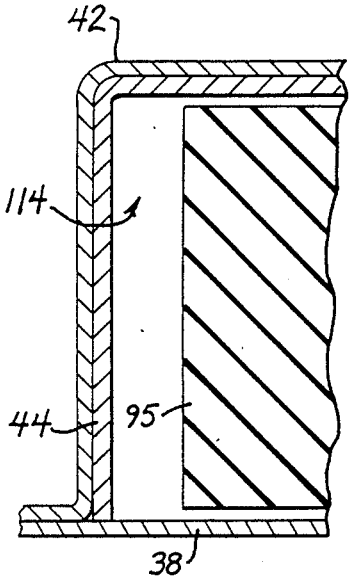
FIG. 10 is a sectional view taken along line 10—10 of FIG. 9.
Figure 9:
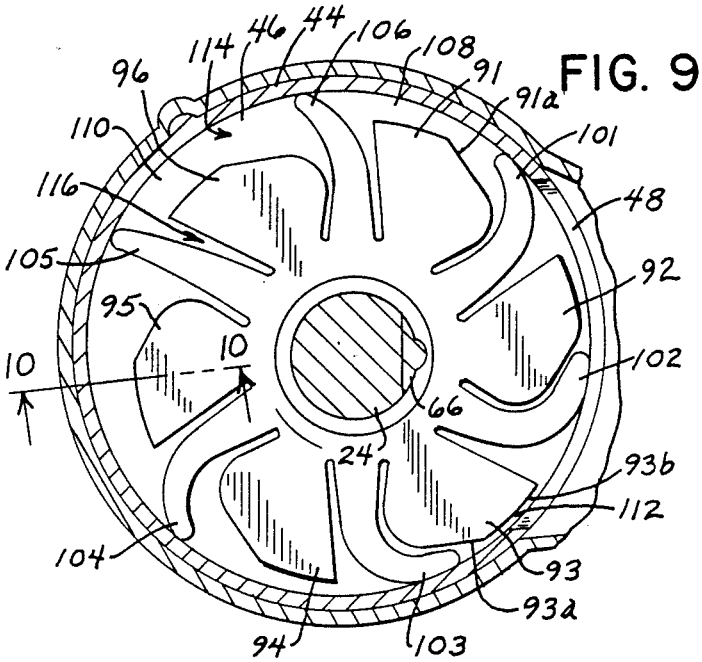
FIG. 9 is a view like FIG. 7 but shows the impeller of FIG. 8.

In another embodiment as shown in FIGS. 8–10, impeller 90 has a plurality of filler blades 91, 92, 93, 94, 95, 96 extending radially outwardly from hub portion 98 between respective vanes 101, 102, 103, 104, 105, 106. The filler blades 91–96 occupy space between vanes 101–106 and displace volume in pumping chamber 46, FIG. 9. The filler blades have tapered leading edges, as shown at edge 91*a* for filler blade 91, accommodating flexure of the respective vane during greatest flexure thereof. For example, in FIG. 9, filler blade 93 has tapered leading edge 93*a* accommodating flexure of vane 103 at its greatest portion of flexure during rotation of the impeller. In FIG. 9, the driveshaft and impeller rotate clockwise.

Filler blades 91–96 are spaced radially inwardly of sidewall 44 and out of engagement therewith and define radial gaps such as 108 between such filler blades and circumferential sidewall 44. The radial widths of such gaps vary during rotary travel between a portion of largest radial gap 110 at a portion of least flexure of the adjacent vane 105, and a portion of least radial gap 112 at the portion of greatest flexure of the adjacent vane 103. The filler blades have an outer edge, for example as shown at 93*b*, substantially adjacent sidewall 44 and with minimal clearance 112 therebetween when the adjacent vane 103 is at maximum flexure.

The pumping volume of chamber 46 is along the inner periphery 114 of sidewall 44, between sidewall 44 and the filler blades. The inner volume 116 otherwise radially inward of pumping volume 114 is substantially displaced by filler blades 91–96. This displacement of inner volume 116 improves air pumping efficiency and provides the above-noted higher dry lift capability and quicker priming.

It has been found that the displacement of inner volume 116 by filler blades 91–96 does not reduce water pumping efficiency because the effective water pumping volume of chamber 46 is along the inner periphery 114 of sidewall 44, not along inner volume 116. Without the filler blades, water is merely recirculated along inner volume 116.

Figure 11:
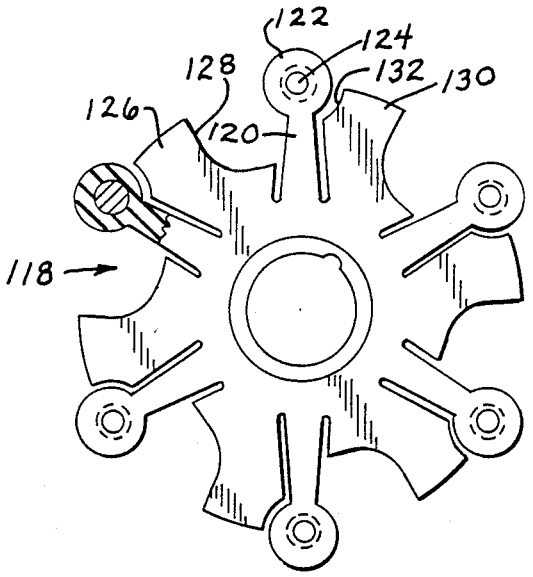
FIG. 11 is a top view of another alternate impeller embodiment.

FIG. 11 shows a further embodiment of an impeller 118 having vanes such as 120 with enlarged outer tips such as 122. Weights such as 124 may be provided at the outer tips, or such weights may be omitted. Filler blades such as 126 have a leading edge with a taper as shown at 128 generally conforming to the profile of enlarged outer tip 122 to accommodate flexure of vane 120. In the embodiment shown in FIG. 11, enlarged outer tip 122 has a circular or convex profile, and the tapered leading edge of filler blade 126 has a concave arcuate profile as shown at 128 for receiving in complementary relation outer tip 122 upon flexure of vane 120. Filler blade 130 ahead of vane 120 has a tapered trailing edge of concave arcuate profile as shown at 132, accommodating the circular cross-section of outer tip 122 of vane 120 therebehind in nonflexed condition. Each filler blade thus has a concave profiled leading edge and a concave profiled trailing edge.

Figure 12:
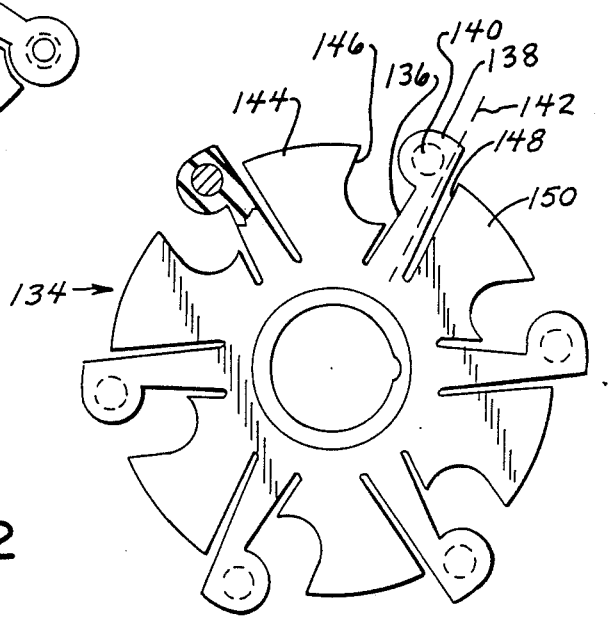
FIG. 12 is a top view of another alternate impeller embodiment.
Figure 13:
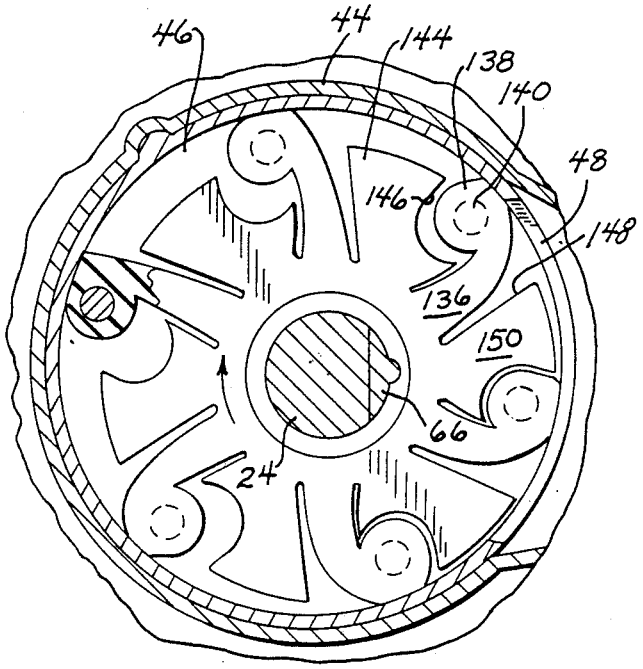
FIG. 13 is a view like FIG. 9 but shows the impeller of FIG. 12.

FIG. 12 shows a further embodiment of an impeller 134 with a plurality of vanes 136 each having an enlarged outer tip 138 with or without a weight 140. As in FIG. 6, enlarged outer tip 138 and weight 140 are offset from the radial line 142 of the vane. Filler blades 144 have tapered leading edges with an arcuate configuration at 146 receiving in complementary relation offset enlarged outer tip 138 upon flexure of vane 136, as shown in FIG. 13. In FIG. 13, the driveshaft and impeller rotate clockwise. The trailing edge 148 of the filler blade 150 ahead of vane 136 need not be tapered, due to the offset of enlarged outer tip 138.

The embodiments in FIGS. 11–13 solve both of the above-noted problems in combination. The weights provide higher pump pressure, and the filler blades provide higher dry lift.

Filler blades 144, 150 have an outer edge substantially adjacent sidewall 44 of the pump housing chamber 46 but always spaced therefrom by a gap therebetween, FIG. 13, including when the adjacent vane 136 is at maximum flexure. The filler blades have a leading edge 146 accommodating flexure of the respective vane 136 during greatest flexure thereof and conforming to the profile of the outer tip 138 vane 136 and always providing a gap therebetween, FIG. 13, including when vane 136 is at maximum flexure. Vanes 136 have enlarged outer tips 138 of convex profile, FIG. 13. The leading edge 146 of the respective filler blade 144 has a concave arcuate profile, FIG. 13, for receiving in complementary relation the outer tip 138 upon flexure of vane 136 but maintaining the noted gap, FIG. 13, between the outer tip 138 of the vane at its convex profile and the leading edge 146 of the filler blade at its concave arcuate profile. These gaps prevent frictional heat which limits pump life if subjected to a dry running mode as in a marine environment.

It is recognized that various equivalents, alternatives and modifications are possible within the scope of the appended claims.

I claim:

1. A pump impeller for a rotary vane positive displacement pump having a pump driveshaft extending axially through a pump housing having a circumferential sidewall defining a pumping chamber, said impeller comprising an annular hub portion driven by said driveshaft and a plurality of flexible vanes extending radially outwardly therefrom in said chamber and having outer tips engaging said sidewall, said impeller also comprising a plurality of filler blades extending radially outwardly from said hub portion between respective said vanes and occupying space therebetween and displacing volume in said chamber, said vanes moving through portions of varying flexure during rotation of said driveshaft, said filler blades being spaced radially inwardly of said sidewall and out of engagement therewith at all times and defining radial gaps therebetween, the radial width of which vary during rotary travel between a portion of largest radial ga at a portion of least flexure of the adjacent vane, and a portion of least redial gap at the portion of greatest flexure of the adjacent vane, the pumping volume of said chamber being along the inner periphery of said sidewall between said sidewall and said filler blades, the inner volume otherwise radially inward of said pumping volume being substantially displaced by said filler blades, said filler blades have an outer edge substantially adjacent said sidewall but always spaced therefrom by a gap therebetween including when the adjacent vane is at maximum flexure, said filler blades having a leading edge accommodating flexure of the respective vane during greatest flexure thereof and conforming to the profile of said outer tip of said vane and always providing a gap therebetween including when the vane is at maximum flexure.

2. The invention according to claim 1 wherein said vanes have enlarged said outer tips of a convex profile, and wherein said leading edge of the respective said filler blade has a concave arcuate profile for receiving in complementary relation said outer tip upon flexure of the respective said vane but maintaining said gap between said outer tip of said vane at said convex profile and said leading edge of said filler blade at said concave arcuate profile.

* * * * *